US010321754B1

(12) United States Patent
McCaughey

(10) Patent No.: US 10,321,754 B1
(45) Date of Patent: Jun. 18, 2019

(54) SELF-PROPELLED SUBSTRATE FINISHING TOOL

(71) Applicant: McCAUGHEY ENTERPRISES, INC., Marion, IA (US)

(72) Inventor: Jeff McCaughey, Marion, IA (US)

(73) Assignee: McCaughey Enterprises, Inc., Marion, IA (US)

( * ) Notice: Subject to any disclaimer, the term of this patent is extended or adjusted under 35 U.S.C. 154(b) by 0 days.

(21) Appl. No.: 15/841,489

(22) Filed: Dec. 14, 2017

Related U.S. Application Data

(60) Provisional application No. 62/441,628, filed on Jan. 3, 2017.

(51) Int. Cl.
*A46B 13/02* (2006.01)
*E01C 19/43* (2006.01)
*B08B 1/00* (2006.01)

(52) U.S. Cl.
CPC ..... *A46B 13/02* (2013.01); *B08B 1/002* (2013.01); *E01C 19/43* (2013.01); *A46B 2200/40* (2013.01)

(58) Field of Classification Search
CPC ..... E01C 19/42; E01C 19/48; E01C 19/43; E01C 2301/14; E01C 2301/16; A46B 13/02; A46B 2200/40; B08B 1/002
See application file for complete search history.

(56) References Cited

U.S. PATENT DOCUMENTS 774,005 A 11/1904 Thies
1,291,544 A 1/1919 Keenan
1,586,325 A * 5/1926 Older ..... E01C 19/42 404/118
1,626,879 A * 5/1927 Shidler ..... E01C 19/236 404/124
3,595,143 A 7/1971 Polselli
3,596,578 A 8/1971 Jones
3,703,857 A 11/1972 Mackinnon
3,846,036 A 11/1974 Baker
3,906,580 A 9/1975 Smith et al.
3,936,209 A 2/1976 Krage
3,936,210 A 2/1976 Oehlerking
3,989,401 A 11/1976 Moench
4,032,249 A 6/1977 Devitis
4,070,128 A 1/1978 Garrison
4,743,140 A 5/1988 Maletic
4,744,694 A 5/1988 Leone
4,759,658 A 7/1988 Manor
4,784,517 A 11/1988 Bergqvist et al.
4,789,265 A 12/1988 Wilson et al.
4,861,188 A 8/1989 Rouillard
4,882,802 A 11/1989 LeVere, Jr.
4,917,533 A 4/1990 Wilson
4,921,372 A 5/1990 Hybertson
5,061,115 A * 10/1991 Godbersen ..... E01C 19/42 404/102
5,073,062 A * 12/1991 Leone ..... B28B 11/0863 404/75

(Continued)

*Primary Examiner* — Abigail A Risic

(74) *Attorney, Agent, or Firm* — Shuttleworth & Ingersoll, PLC; Jason Sytsma

(57) ABSTRACT

A sled for finishing a substrate with a displacement apparatus is attachable to the sled for moving the sled relative to the substrate. A tracking line is engagable by the displacement apparatus to provide a path of travel for the sled such that the sled moves along the tracking line across the substrate.

13 Claims, 6 Drawing Sheets

(56) References Cited

U.S. PATENT DOCUMENTS

| | | | | |
|---|---|---|---|---|
| 5,452,490 | A | 9/1995 | Brundula et al. | |
| 5,549,413 | A | 8/1996 | Bolden | |
| 5,638,656 | A * | 6/1997 | Roe | E01C 19/43 15/79.1 |
| 2008/0093199 | A1 * | 4/2008 | Reynebeau | D21F 1/32 198/496 |

* cited by examiner

Fig. 2.
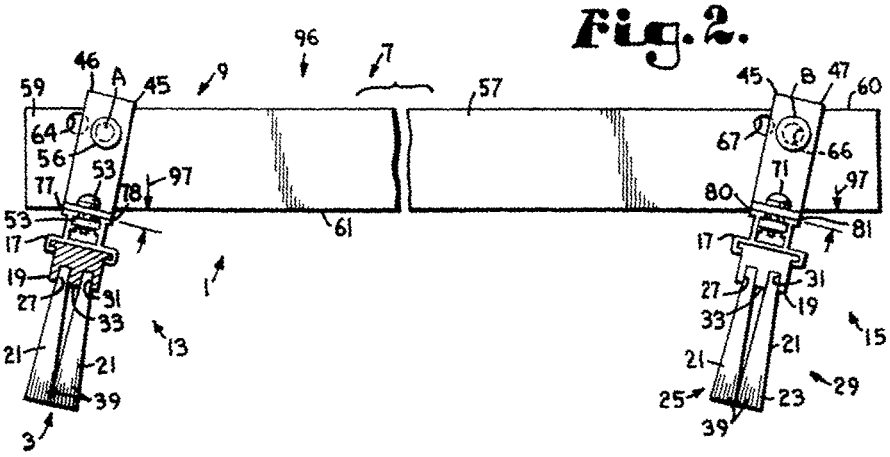
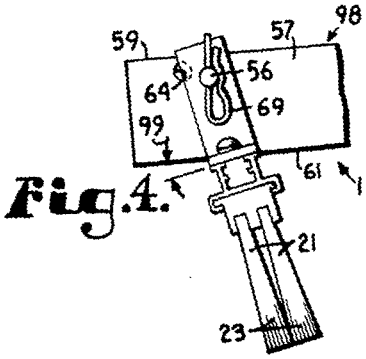
Fig. 4.
Fig. 7.
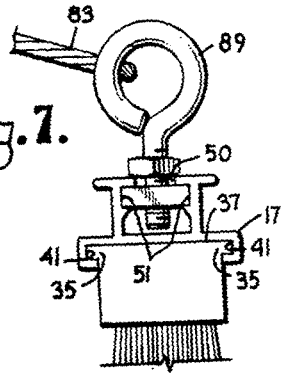
Fig. 6.
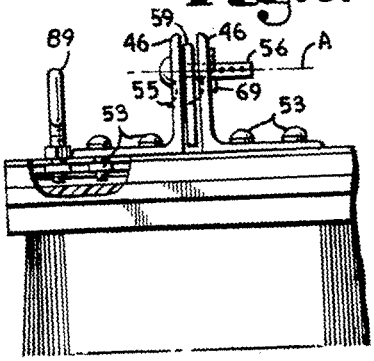

SELF-PROPELLED SUBSTRATE FINISHING TOOL

CROSS-REFERENCE TO RELATED APPLICATIONS

The present application claims the benefit of U.S. Provisional Application No. 62/441,628 filed Jan. 3, 2017 which is incorporated herein by reference.

TECHNICAL FIELD

This invention relates to a substrate finishing tool, and more specifically, this invention relates to a self-propelled substrate finishing tool for striating freshly placed substrate.

BACKGROUND INFORMATION

Concrete is used for a multitude of different applications including the formation of substantially horizontal, hard surfaces commonly referred to as flatwork. The concrete is initially formed into a pourable and workable substance comprising cement, rock aggregate, water, and other additives. The concrete is then poured into forms or other containing structures where it hardens, or "cures". As the concrete begins to harden, it is generally worked with trowels, troweling machines or various other instruments in order to obtain a relative uniform, non-wavy, durable surface. As a result of such activity, the surface of the concrete may obtain a relatively smooth texture, which can be dangerous for some applications—such as sidewalks, driveways, highways, and the like—particularly when the surface is damp, frosty or icy.

To minimize such dangers, the concrete is given a roughened surface as it is hardening, sometimes referred to as a "broom" finish. Such roughening is sometimes accomplished by pushing or dragging the bristles of a broom across the surface of the hardening concrete in a direction generally perpendicular to the anticipated flow of traffic on that surface. As a result, the surface is scored with randomly spaced bristle marks, which marks harden in the surface of the concrete thereby providing a surface which minimizes tendencies for slipping.

The degree of scoring for a particular surface generally depends on the anticipated use of that surface. Sidewalks and patios, which are primarily exposed only to foot traffic, for example, need only light or fine scoring to provide a slip-resistant surface. On the other hand, highways, streets, parking lots and bridges, which are primarily subjected to vehicular traffic as opposed to foot traffic, generally require much coarser scoring in order to provide a slip-resistant surface for the vehicles traveling therealong.

It is well known to use a garage-type push broom or brush to roughen or score the surface of concrete. Such brushes typically have a width of two feet, or less. Some prior art brushes specially manufactured for finishing concrete have widths of 24, 36 or 48 inches. The bristles thereof, which are generally constructed of polypropylene, horsehair, or nylon, are generally staple set or otherwise formed into channel style strips in a wooden head such that the bristles extend generally perpendicularly downwardly from the wooden head. Another problem with the wooden heads of prior art brushes is the relatively rapid deterioration of the wooden heads due to exposure thereof with the corrosive constituents of the concrete material.

To maneuver the brush over the surface of the wet concrete, the brush head is generally attached to the end of a long handle having a sufficient number of sections attached end-to-end such that a user can reach either entirely across the flatwork or at least half-way across, depending on the width of the flatwork. The user then places the bristles of the brush against the flatwork at the side of the flatwork nearest the user and uses the handle to push the brush in a straight line to the side of the flatwork opposite from the user (or slightly beyond midway as the case may be).

Then, using the handle as a lever, the user lifts the brush clear of the flatwork and maneuvers the brush to a new position on the flatwork immediately adjacent to that from which the brush was lifted. In fact, the brush is spaced such that the return path to be swept by the brush slightly overlaps the previous path in order to avoid leaving an unroughened strip of concrete between the adjacent sweeps. The handle is then used to pull the brush back to the side of the flatwork nearest the user. The described process is repeated until either the entire surface, or half of the surface nearest the user, is "broomed". If only half of the surface is reachable by the long handle, the user then proceeds to the opposite side of the flatwork to broom the remaining half of the flatwork.

Depending on the length of the handle, a considerable torque or moment must sometimes be applied by the user to lift the brush from the concrete, particularly since the brush becomes gradually heavier due to the concrete that accumulates in and on the brush during use. Additional responsibility is placed on the user to avoid allowing the brush to drop back against or bump the surface of the concrete as the bristles are directed substantially perpendicularly to the surface and can easily gouge concrete material from the surface.

Another complication arising from the use of a prior art concrete finishing brush is the long handle, while limits the user's ability to use it in congested or crowded quarters, such as inside a building or near surrounding structures, due to interference with the necessary path of the long handle during the pulling and pushing procedure inherent in concrete finishing with a brush having a long handle.

The channel strip-type brushes used in prior art devices have essentially no gaps between the bristles, just one straight row of continuous bristle fill. As a result, such channel strip-type brushes tend to pull or squeegee the "cream" from the surface of the flatwork concrete. In an attempt to avoid this undesirable effect, some prior art concrete finishing brushes have been constructed with staple set-type bristles which pull or squeegee less "cream" than channel strip-type brushes due to a multiple-row configuration of the bristles, wherein each row has a plurality of equally spaced gaps between clusters of bristles, with the gaps of a consecutive row(s) staggered to fill the gaps of the adjacent row(s).

Factors affecting the roughness of the broomed finish include, among other things, the stiffness of the bristles, the angular orientation of the bristles at their point of contact with the flatwork, the softness or "green"-ness of the concrete at the time the roughening finish is applied, etc. As the bristles of most of the prior art brushes are generally approximately perpendicular to the surface of the flatwork, the brush must not be applied too quickly after the "pour", such as when the concrete has just been "floated" and is very soft and creamy. Otherwise, the tips of the bristles will gouge too deeply into the concrete surface or will scrape off the "creamy" surface and expose the aggregate, or both. As a result, brooming of the flatwork concrete with prior art concrete finishing brushes is generally delayed until the concrete begins to "set" whereby it can more readily endure the abusiveness to the flatwork arising from contact with brushes having bristles oriented substantially perpendicularly to the flatwork.

Many times during such delay of using a prior art finishing device, a user may get distracted and not realize that the concrete has hardened more than intended; in other words, the user has waited too long and the concrete has "set" or hardened to the point that the weight of the brush is more easily supported by the green flatwork. Even though some roughening may still be possible, the extent thereof may be substantially less than that desired in order to obtain a slip-resistant surface. Under those circumstances, the user sometimes attempts to enhance the effect of the brooming procedure by tying weights to the brush. Such remedial measure may not provide a practical solution, however, particularly if the user must lift that extra weight at the end of a long handle for the return sweep. In addition, the added weight may cause the surface to become more uneven as some portions of the surface may have cured slightly earlier than other portions of that surface.

An improvement was previously made and disclosed in U.S. Pat. No. 5,549,413, which is directed to a concrete finishing tool that substantially uses the sides of the bristles instead of the ends of the bristles for "brooming" flatwork concrete, that does not require the use of a long handle, that can be used to "broom" the entire width of flatwork even though the flatwork may have virtually unlimited width, that can be used to easily sweep strips having widths substantially greater than four feet, that can be used to uniformly and reliably "broom" a flatwork surface shortly after the concrete is poured thereby avoiding the risk of delaying too long before brooming, that avoids the costs of personnel who might not otherwise be overly productive while waiting for the flatwork to partially set as required by prior art concrete finishing devices, that can be used in congested spaces, and that can be quickly disassembled for use with either a push-pin handle or a screw-on handle in a conventional manner while preserving the ability to broom concrete substantially with the sides of the bristles as opposed to the ends of the bristles.

Even this improvement requires substantial effort on the part of the operators. Accordingly, there is a need for an improved substrate finishing tool that requires less effort to operate and a more consistent application.

SUMMARY

In accordance with one aspect of the present invention, a substrate finishing apparatus is provided. The apparatus comprises of a sled for finishing a substrate. A displacement apparatus is attachable to the sled for moving the sled relative to the substrate. A tracking line is engagable by the displacement apparatus to provide a path of travel for the sled such that the sled moves along the tracking line across the substrate.

More specifically, the displacement apparatus can comprise of a first sensor activatable by the tracking line and a second sensor activatable by the tracking line. A frictional wheel can engage the tracking line to drive the sled across the substrate. The first sensor and the second sensor are on opposite sides of the frictional wheel, and a tracking line guide positions the tracking line with respect to the frictional wheel. The first sensor and the second sensor can each be a limit switch with an activation lever that moves between an open state and a closed state. The activation lever of each of the first sensor and the second sensor can be combined to a guide tube to direct the tracking line.

In operation, when a first end of the tracking line is pulled taut the activation lever of the first sensor moves to a closed state, and when a second end of the tracking line is pulled taut the activation lever of the second sensor moves to a closed state. When the first sensor and the second sensor are each in a closed state, the frictional wheel rotates to move the sled across the substrate. The frictional wheel can comprise a plurality of pointed protrusions to pierce the tracking line during rotation. A reverse switch can be provided to switch a rotational direction of the frictional wheel.

BRIEF DESCRIPTION OF THE DRAWINGS

FIG. 2 is an enlarged and fragmentary, side elevational view of the multi-purpose substrate finishing apparatus, showing a selected angular orientation automatically assumed by brushes thereof as the apparatus is being pulled to the right.

FIG. 4 is an enlarged and fragmentary, side elevational view of the multi-purpose substrate finishing apparatus, similar to FIG. 2 but showing the angular orientation automatically assumed by the brushes as the apparatus is being pulled to the left.

FIG. 6 is a further enlarged and fragmentary, side elevational view of the multi-purpose substrate finishing apparatus, showing a portion cut away to reveal details thereof.

FIG. 7 is a yet further enlarged and fragmentary, end elevational view of the multi-purpose substrate finishing apparatus, showing details of a block thereof.

DETAILED DESCRIPTION OF THE PREFERRED EMBODIMENTS

Figure 1:
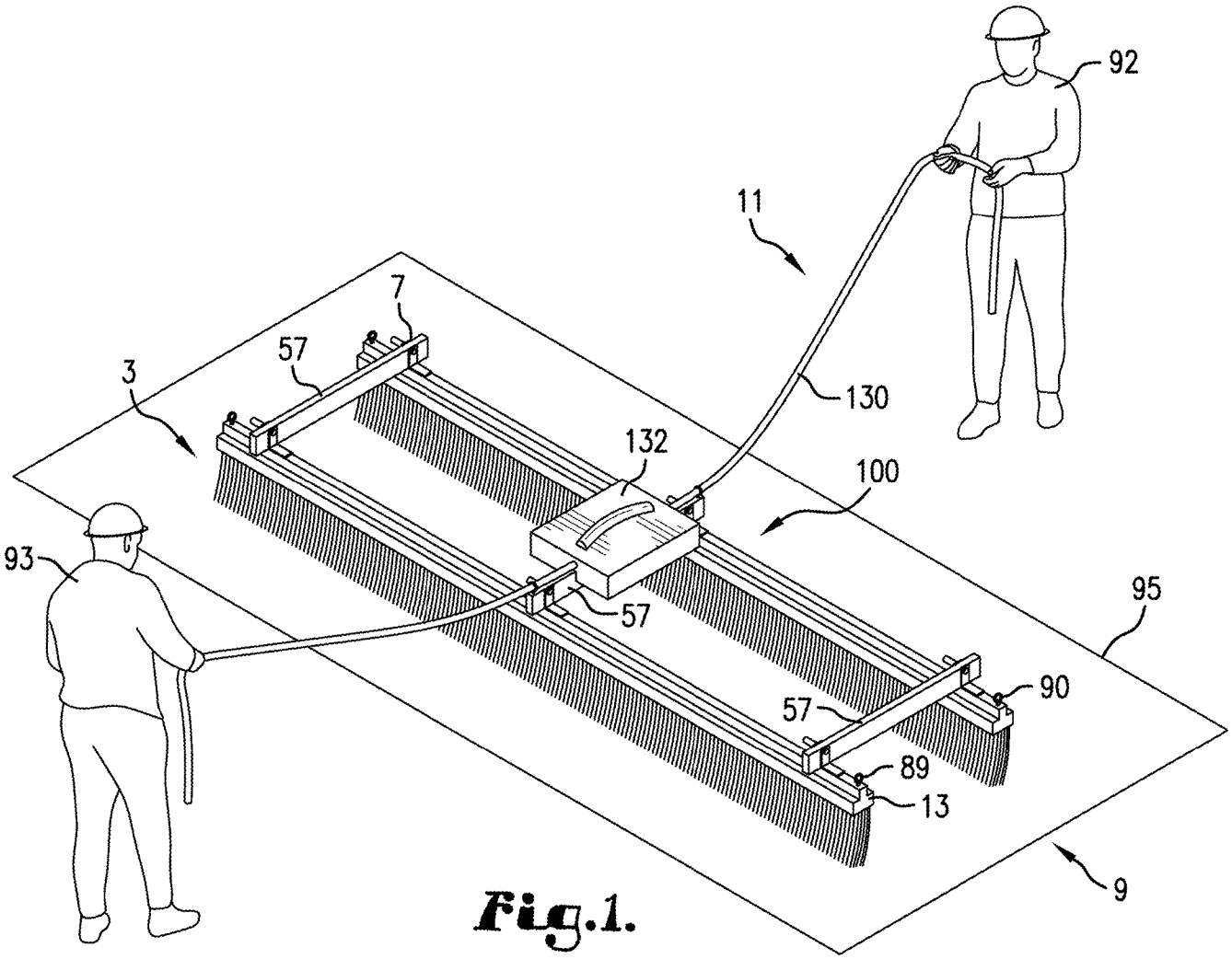
FIG. 1 is a perspective view of a multi-purpose substrate finishing apparatus, according to the present invention.
Figure 3:
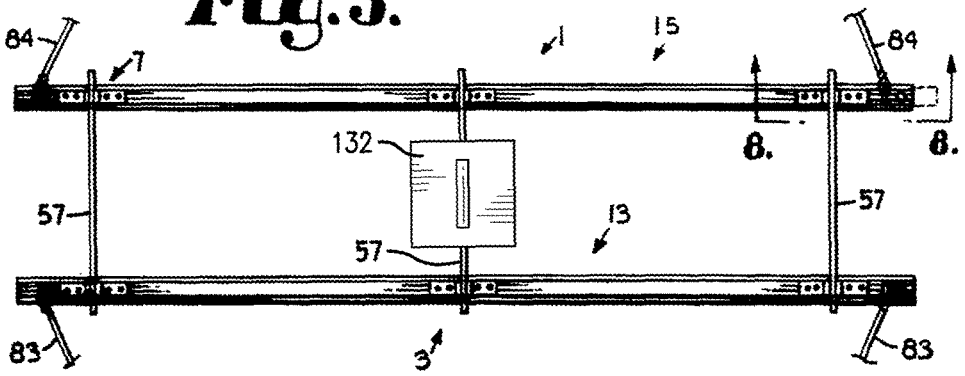
FIG. 3 is a fragmentary, plan view of the multi-purpose substrate finishing apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The substrate finishing apparatus 1, as shown in FIGS. 1 through 11, comprises a sled 100 with a texturing apparatus 3 for texturing or roughening the surface of freshly poured substrate flatwork 5, mounting apparatus 7 for mounting the texturing apparatus 3 and a control apparatus 9 for controlling the texturing apparatus 3. Sled 100 can be configured for self-propulsion by a displacement apparatus 11 for moving the sled 100 relative to the flatwork 5. Sled 100 can be of any type and any configuration useful for applying different types of texture of finish to flatwork 5. An exemplary sled 100 is disclosed in U.S. Pat. No. 5,549,413, the content of which are incorporated herein by reference.

The texturing apparatus 3 of sled 100 generally includes a pair of brush assemblies 13 and 15, each with a head 17, a bristle block 19 and bristles 21. Preferably, the heads 17 are constructed of lightweight material, such as extruded aluminum or other suitable material, which is acceptably durable when exposed to the corrosive and degrading constituents contained in concrete material. The bristles 21 are constructed of fill 23 with an acceptable bend recovery rate, such as 6/12 nylon or other suitable material. For some applications, the fill 23 is preferably "soft", such as 0.010" diameter nylon. For other applications, the fill 23 is preferably "stiff" such as 0.022" diameter nylon. For yet other applications, the fill 23 has a "medium" stiffness, such as 0.016" diameter nylon. For ease of identification, each stiffness is preferably color-coded, such as black for "soft", orange for "medium", and green for "stiff".

Each of the blocks 19, which is constructed of High Density Polyethylene ("HDPE") or other suitable material, has a first set 25 of uniformly and linearly spaced partial bores 27 which are spaced parallel to a second set 29 of uniformly and linearly spaced partial bores 31 in a bottom surface 33 of each of the blocks 19, as shown in FIG. 2. The set 25 is axially offset from the set 29 such that the partial bores 27 are staggered relative to the partial bores 31. Each of the blocks 19 has a pair of opposing, outwardly directed ridges 35 along an upper surface 37 thereof, as shown in FIG. 7.

The diameter of each of the bores 27 and 31 and the spacing therebetween is dependent upon the diameter, quantity and length of the fill 23 being used for each bristle cluster 39 of the bristles 21. For example, the bores 27 and 31 may each have a diameter of approximately 13/64 inch, a center-to-center spacing between adjacent ones of the bores 27 and between adjacent ones of the bores 31 of approximately 5/16 inch, and a center-to-center spacing between the set 25 and the set 29 of approximately 7/16 inch. Each of the bristle clusters 39 is secured to its respective bore 27 or 31 by stapling, or other suitable means. In the preceding example, the bristles 21 may extend approximately 2¼ inches generally perpendicularly outwardly from the respective blocks 19.

Figure 8:
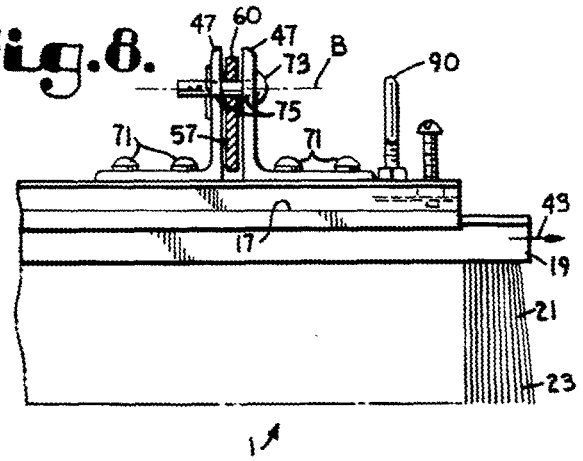
FIG. 8 is a further enlarged and fragmentary, side elevational view of the multi-purpose substrate finishing apparatus, taken along line 8-8 of FIG. 3, showing the block being removed.

The head 17 has a pair of opposing, inwardly directed grooves 41 which are adapted to cooperatively receive the ridges 35 slidingly and longitudinally therethrough, as indicated by the arrow designated by the numeral 43 in FIG. 8. The ridges 35 are generally frictionally retained with the grooves 41. The length of the head 17 is generally co-extensive with the length of the block 19 contained therein.

It is to be understood that, for some applications, several of the blocks 19 may be contained within the head 17, with the blocks 19 having a combined length co-extensive with the length of the head 17. For example, shorter sections of the blocks 19 normally have lower friction relative to the head 17 and can be more easily removed and reinserted into the grooves 41 than can a single one of the blocks 19 having a length co-extensive with the head 17.

The mounting apparatus 7 generally include a plurality of opposing pairs of brackets 45, such as the opposing pairs of brackets 45. Each of the heads 17 generally has an upwardly directed slot 50 with a pair of opposing and inwardly directed grooves 51, as shown in FIG. 7. Each pair of the opposing pairs of brackets 46 are connected to the respective head 17 by bolts and nuts 53 slid lengthwise along the slot 50 as desired and secured in place.

Figure 5:
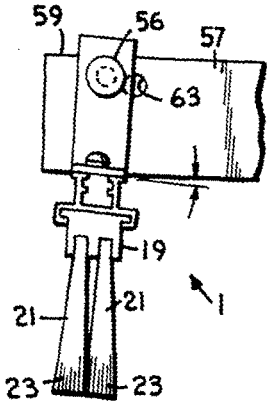
FIG. 5 is an enlarged and fragmentary, side elevational view of the multi-purpose substrate finishing apparatus, similar to FIG. 4 but showing a different selected angular orientation assumed by the brushes as the apparatus is being pulled to the right.

Each of the pairs of brackets 46 has as aligned pair of throughbores 55 for slidably receiving a pivot pin 56 therethrough, as shown in FIG. 6. The mounting apparatus 7 also include a plurality of spacers 57, each having a first end 59 a second end 60, and a lower edge 61. Each of the spacers 57 generally has one or more throughbores in each of the ends 59 and 60, such as the throughbores 63 and 64 in the end 59 for slidably receiving the pivot pin 56 therethrough, as shown in FIGS. 4 through 6, and the throughbores 66 and 67 in the end 60, as shown in FIG. 2. A keeper 69 retains the pivot pin 56 such that the spacers 57 pivot about axis "A" relative to the brackets 46, as shown in FIGS. 2 and 6.

Similarly, the brush assembly 15 is attached to the opposing pairs of brackets 47 by nuts and bolts 71. Again, each of the opposing pairs of brackets 47 is pivotally connected by a pivot pin 73 inserted through a respective throughbore 66 or 67 in the end 60 and through an aligned pair of throughbores 75 in the brackets 47, such that the spacers 57 pivot about axis "B" relative to the brackets 47, as shown in FIGS. 2 and 8.

The control apparatus 9 include each of the throughbores 63 and 66 being spaced equidistantly from the lower edge 61, the throughbores 64 and 67 being spaced equidistantly from the lower edge 61, and the throughbores 55 and 75 being spaced equidistantly from corners 77 and 78, and from corners 80 and 81, respectively, as shown in FIG. 2.

The displacement apparatus 11 is removably mountable to sled 100 to convert a manually maneuvered sled 100 into one operated by self-propulsion. Because displacement apparatus 11 is removable from sled 100, displacement apparatus is easily cleanable and stored in a clean environment. Also, if displacement apparatus 11 malfunctions, sled 100 can be operated manually in the traditional manner. The user merely removes displacement apparatus 11 and replaces it with another spacer 57 and reconfigures tracking line 130. Displacement apparatus 11 generally includes a tracking line 130 and a control box 132 housing a motor 134 and operating circuitry 136 necessary to operate motor 134. Motor 134 drives a frictional wheel 138 which engages tracking line 130 to drive sled 100 along tracking line 130.

Figure 11:
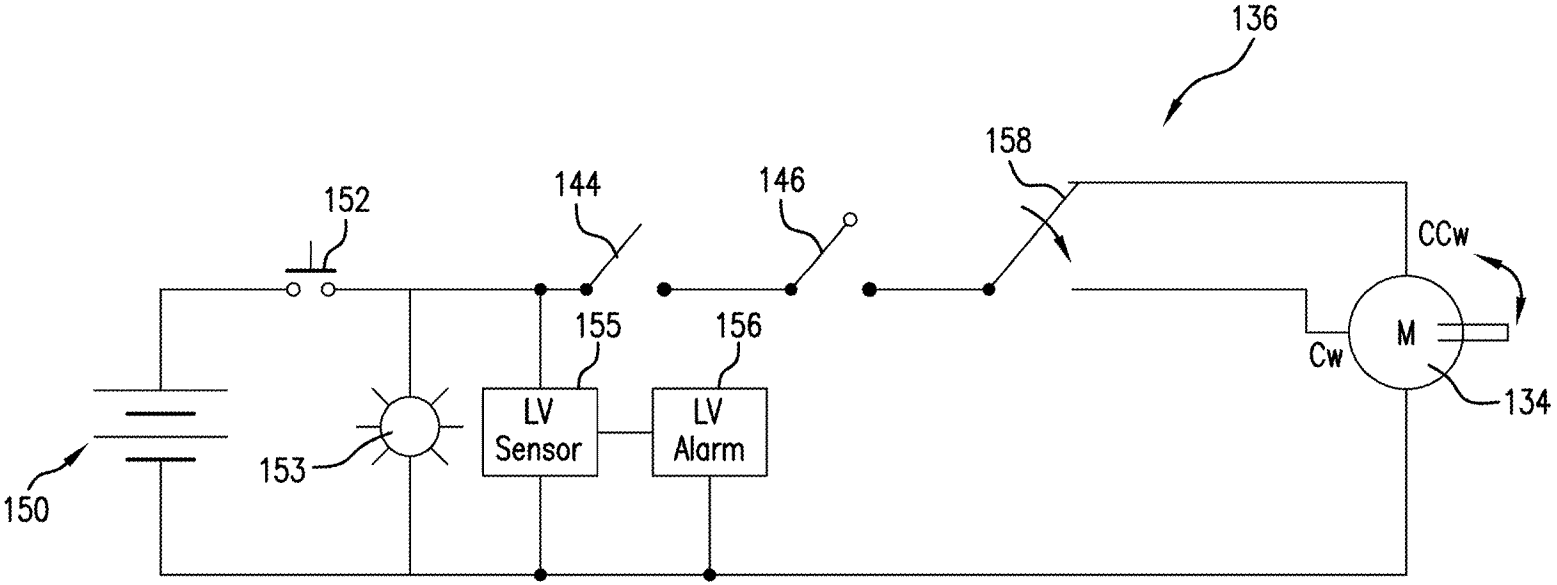
FIG. 11 is an electrical schematic of the operating circuitry for the displacement apparatus.

As shown in FIG. 11, operating circuitry 136 comprises of a power source 150 that is turned on/off by a power switch 152 with its state indicated by a power indicator light 153. A low voltage sensor 155 senses when power source 150 is low on power and activates a low voltage alarm 156, such as a buzzer or light, to warn the operator of the same. A first sensor 144 and a second sensor 146 are positioned electrically-between power source 150 and motor 134 to control the operation of motor 134. A directional switch 158 can be positioned electrically-between second sensor 146 and motor 134 to switch a rotational direction of motor 134.

Figure 9:
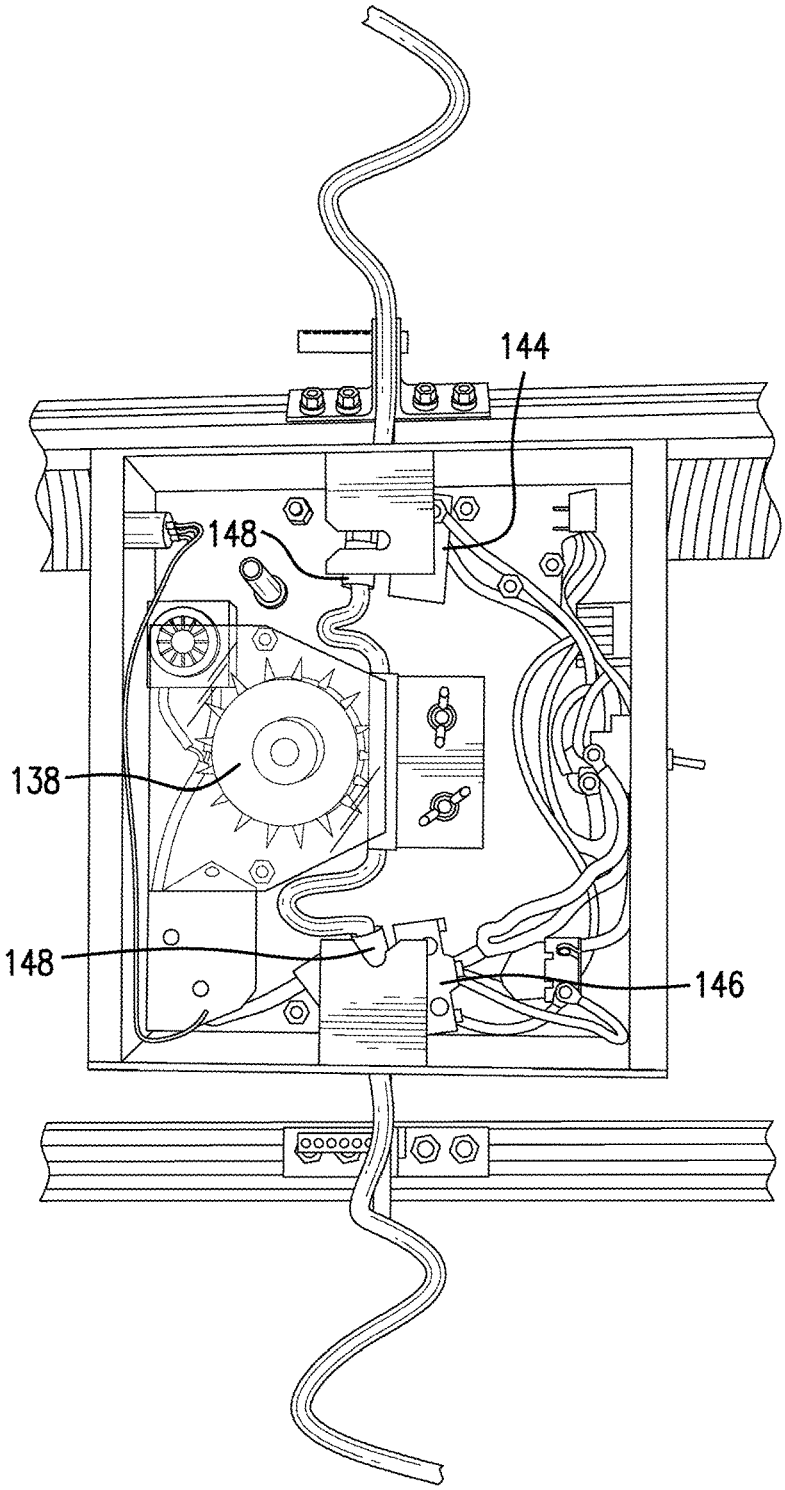
FIG. 9 is a close up view of the displacement apparatus with the tracking line loose.
Figure 10:
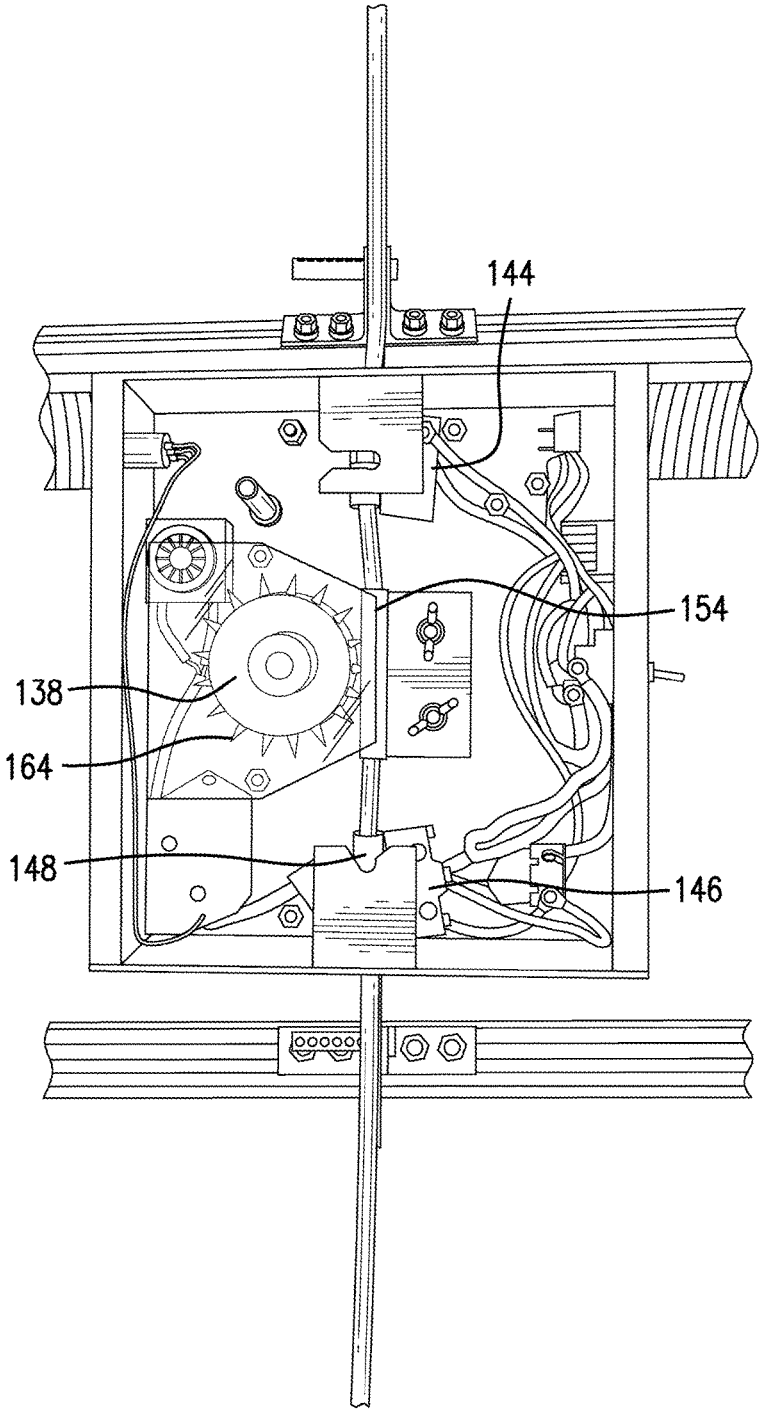
FIG. 10 is a close up view of the displacement apparatus with the tracking line pulled taut.

Turning to FIGS. 9-10, first sensor 144 and second sensor 146 are positioned on opposite sides of control box 132 for sensing an on command to initiate engagement by frictional wheel 138 of tracking line 130. The on command to initiate engagement by frictional wheel 138 of tracking line 130 can be when tracking line 130 is pulled taut by user 92 and user 93. In an embodiment, first sensor 144 and second sensor 146 are each limit switches with an activation lever 148. First sensor 144 and second sensor 146 can be any type of sensors, for example, motion sensors, tension sensors, strain gauges, image recognitions sensors (e.g. a camera) with image recognition software, etc. In embodiments where first sensor 144 and second sensor 146 use image recognition sensors, sled 100 can traverses across substrate flatwork 5 to the respective ends of substrate flatwork 5. In such embodiments, the on command to initiate engagement by frictional wheel 138 of tracking line 130 can be when the image recognition sensors sense substrate flatwork 5 in front of sled 100.

First sensor 144 and second sensor 146 are positioned in relative proximity to tracking line 130, so that in a relaxed state, as shown in FIG. 9, tracking line 130 is loose and the first sensor 144 and second sensor 146 are both open with the activation lever 148 of each of first sensor 144 and second sensor 146 in an open state. When user 92 and user 93 each pull tracking line 130 taut, as shown in FIG. 10, tracking line 130 firms up and moves into position against the activation lever 148 of each of first sensor 144 and second sensor 146 thereby closing each of first sensor 144 and second sensor 146. Each of first sensor 144 and second sensor 146 must be closed for motor 134 to be powered. This means that if one of the users is not paying attention and is not holding tracking line 130 taut, motor 134 is not engaged and sled 100 won't move. Finally, each activation lever 148 can further have a guide tube 160 combined thereto, to more precisely locate tracking line 130 and close activation lever 148. With both of first sensor 144 and second sensor 146 closed, motor 134 is powered and drives a frictional wheel 138.

In operation, user 92 and user 93 each pull their respective ends of tracking line 130 taut. This engages the frictional wheel 138 to move sled 100 across flatwork 5. Upon completion of the sweep from the side 94 to the side 95, the user 92 simply picks up the apparatus 1, such as by one or more of the centrally located ones of the spacers 57, switches directional switch 158 to reverse the rotational direction of motor 134, and places the apparatus 1 down on the flatwork 5 at the side 95 such that the next sweep of the apparatus 1 will slightly overlap the sweep that was just completed. Then, user 92 and user 93 each pull their respective ends of tracking line 130 taut to the frictional wheel 138 to move sled 100 across flatwork 5. It is to be understood that while certain forms of the present invention have been illustrated and described herein, it is not to be limited to the specific forms or arrangement of parts described and shown.

Displacement apparatus 11 comprises of a housing or control box 132 to house operating circuitry 136 and frictional wheel 138. The inside of control box 132 is shown in FIGS. 9-10. As show, tracking line 130 enters in one end of control box 132 and out the other end of control box 132. In between, is the first sensor 144 and second sensor 146, as previously discussed. Between first sensor 144 and second sensor 146 is the frictional wheel 138. In an embodiment where tracking line 130 is a nylon rope, it can be advantageous to configure frictional wheels 138 with a plurality of pointed protrusions 164 to pierce tracking line 130 during rotation. This provides a higher frictional engagement without encouraging a higher load on motor 134. A tracking line guide 154 can positioned on the other side of tracking line 130 from frictional wheel 138 to keep tracking line 130 while it is pressed upon by frictional wheels 138.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A substrate finishing apparatus, comprising:

a sled with a texturing apparatus for applying a surface finish to a substrate;

a displacement apparatus attachable to the sled for moving the sled relative to the substrate and comprising a first sensor with an activation lever that moves between an open state and a closed state, a second sensor with an activation lever that moves between an open state and a closed state, a friction wheel, and a tracking line guide; and a tracking line engagable by the displacement apparatus to provide a path of travel for the sled wherein the sled moves along the tracking line across the substrate; and wherein the tracking line guide positions the tracking line with respect to the frictional wheel, and the friction wheel engages the tracking line to drive the sled across the substrate, wherein the first sensor is activatable by the tracking line and the second sensor is activatable by the tracking line.

2. The apparatus of claim 1, wherein first sensor and the second sensor are on opposite sides of the frictional wheel.

3. The apparatus of claim 1, wherein each of the first sensor and the second sensor are each a limit switch.

4. The apparatus of claim 1, wherein the activation lever of each of the first sensor and the second sensor is combined to a guide tube to direct the tracking line.

5. The apparatus of claim 4, wherein when a first end of the tracking line is pulled taut the activation lever of the first sensor moves to a closed state; and wherein when a second end of the tracking line is pulled taut the activation lever of the second sensor moves to a closed state.

6. The apparatus of claim 5, wherein when the first sensor and the second sensor are each in a closed state, the frictional wheel rotates to move the sled across the substrate.

7. The apparatus of claim 6, wherein the frictional wheel further comprises a plurality pointed protrusions to pierce the tracking line during rotation.

8. The apparatus of claim 7, wherein the displacement apparatus further comprises a reverse switch to switch a rotational direction of the frictional wheel.

9. A substrate finishing apparatus that moves along a tracking line across a substrate, the apparatus comprising:

a sled with a texturing apparatus for applying a finish to a substrate;

a frictional wheel attachable to the sled that engages the tracking line to drive the sled across the substrate;

a first sensor for sensing an on command to initiate engagement by the frictional wheel of the tracking line; and a tracking line guide to position the tracking line with respect to the frictional wheel.

10. The apparatus of claim 9, and further comprising a second sensor for sensing an on command to initiate engagement by the frictional wheel of the tracking line.

11. The apparatus of claim 10, wherein the first sensor and the second sensor are each are a limit switch with an activation lever that moves between an open state and a closed state when the tracking line is pulled taut, wherein the on command to initiate engagement by the frictional wheel of the tracking line is when the tracking line is pulled taut.

12. A substrate finishing apparatus, comprising:

a sled with a texturing apparatus for applying a surface finish to a substrate;

a displacement apparatus attachable to the sled for moving the sled relative to the substrate and comprising a first sensor and a second sensor; and a tracking line engagable by the displacement apparatus to provide a path of travel for the sled wherein the sled moves along the tracking line across the substrate, wherein the first sensor is activatable by the tracking line and the second sensor is activatable by the tracking line.

13. The apparatus of claim 12, wherein the displacement apparatus further comprises of a frictional wheel to engage the tracking line, and a tracking line guide to position the tracking line with respect to the frictional wheel, wherein the first sensor and the second sensor are activatable when the tracking line is pulled taut which causes rotation of the frictional wheel.

* * * * *